US005123747A

United States Patent [19]

Derksen

[11] Patent Number: 5,123,747

[45] Date of Patent: Jun. 23, 1992

[54] CLAMPING AND ALIGNING MEANS FOR A MIXER

[75] Inventor: Michael Derksen, Ludenscheid, Fed. Rep. of Germany

[73] Assignee: Dr. Herfeld GmbH & Co., KG, Neuenrade, Fed. Rep. of Germany

[21] Appl. No.: 412,150

[22] Filed: Sep. 25, 1989

[30] Foreign Application Priority Data

Nov. 10, 1988 [DE] Fed. Rep. of Germany ..... 8814068

[51] Int. Cl.[5] ..... B01F 7/16; B01F 9/08

[52] U.S. Cl. ..... 366/197; 248/130; 366/213; 366/214; 366/224; 414/401

[58] Field of Search ..... 366/26, 53, 54, 56, 366/60, 62, 208, 209, 213, 214, 215, 218, 219, 220, 222, 224, 232, 233, 249, 251, 150; 298/38; 414/401, 402, 419, 421, 225, 783, 396; 269/309; 198/345.1-345.3, 803.3, 803.9, 803.14, 803.15; 248/130

[56] References Cited

U.S. PATENT DOCUMENTS

| | | | |
|---|---|---|---|
| 3,137,327 | 6/1964 | Muench | 366/150 X |
| 3,174,728 | 3/1965 | Mack | 366/213 |
| 3,571,872 | 3/1971 | Van Den Keiboom | 198/345.3 X |
| 3,696,756 | 10/1972 | Elmore et al. | 198/345.3 X |
| 3,746,316 | 7/1973 | Langen et al. | 366/213 |
| 3,810,500 | 5/1974 | Brun et al. | 414/401 |
| 4,100,616 | 7/1978 | Wilson | 366/213 |
| 4,372,686 | 2/1983 | Herfeld | 366/220 |
| 4,555,211 | 11/1985 | Metz | 414/401 |
| 4,671,666 | 6/1987 | Herfeld | 366/224 |
| 4,676,658 | 6/1987 | Herfeld | 366/249 |
| 4,732,258 | 3/1988 | Burgess, Jr. | 198/345.3 |
| 4,757,890 | 7/1988 | Motoda | 414/225 |
| 4,781,468 | 11/1988 | Herfeld | 366/213 |

FOREIGN PATENT DOCUMENTS

| | | | |
|---|---|---|---|
| 1074011 | 1/1960 | Fed. Rep. of Germany | 366/220 |
| 533171 | 3/1921 | France | 366/224 |
| 1600 | 10/1916 | Netherlands | 366/222 |
| 8808403 | 11/1988 | United Kingdom | 414/201 |

*Primary Examiner*—Robert W. Jenkins
*Assistant Examiner*—C. Cooley
*Attorney, Agent, or Firm*—Learman & McCulloch

[57] ABSTRACT

The invention relates to a mixing device the mixing container of which consists of two bowl-shaped vessel parts, at least one stop element being fixed on the transport support and a clamping or draw-in device which can be brought into clamping engagement with the stop element being provided on the guide fork in such a way that the transport support with the first vessel part can be drawn into the starting position of the mixing vessel and locked there.

9 Claims, 2 Drawing Sheets

CLAMPING AND ALIGNING MEANS FOR A MIXER

The invention relates to a mixing device for mixing bulk materials in powdered or granular form.

BACKGROUND OF THE INVENTION

Mixing devices of this type are known in the art in various forms, and the mixing device can be constructed as regards its basic form for example as disclosed in DE-PS 21 10 074 or DE-OS 34 26 159. In the practical construction of these known mixture devices the first vessel part of the mixing vessel, when it is not fixed to the second vessel part, is carried on a transport support which it is releasably fastened. As a result the first vessel part can be transported for example on the one hand between a charging station and the stationary parts of the mixing device and on the other hand between the fixed part of the mixing device and a consuming station.

In order to permit the first vessel part which is filled with a charge of material for mixing to be moved into its starting position under the stationary second vessel part and aligned there with respect to the vertical vessel axis, a guide fork which receives the transport support in the starting position and the mixing position of the mixing vessel is arranged on the stationary mounting of the mixing device.

However, it has been shown in practice that in spite of the provision of the guide from it is often very difficult to bring the transport support together with the filled first vessel part into the starting position for the mixing vessel in the desired manner. This operation of bringing the two parts together must be repeated frequently, particulary in the case of large vessel types, until the transport support with the first vessel part is located exactly in the guide fork and thus under the stationary second vessel part.

SUMMARY OF THE INVENTION

The object of the invention, therefore, is to provide a mixing device in which by relatively simple structural means it is reliably ensured that the first vessel part can be moved quickly into the starting position and accurately aligned with the second vessel part.

In the construction of the mixing device according to the invention on the one hand at least one stop element is provided on the transport support and on the other hand a drawing-in device or clamping means which can be brought into engagement with the stop element is provided on the guide fork. In this way it can be ensured in an extremely reliable manner that the transport support, together with the first vessel part borne on it, is drawn into the starting position of the mixing vessel and locked. Further, this can occur very quickly because of the arrangement and construction of the guide fork and the construction of the transport support to fit the guide form according to the starting position of the mixing device. When the transport support is moved into the guide fork, then the clamping means or draw-in device comes into clamping engagement with the stop element (preferably with at least two stop elements) of the transport support, so that when the draw-in device is actuated the transport support is gripped by means of the stop element immediately upon being first moved in and is drawn in and held exactly in its end position. This end position of the transport support in the guide fork then corresponds to the position of the first vessel part in which the latter is aligned accurately below the second vessel part in the starting position of the mixing vessel.

A further advantage of this construction of the mixing device according to the invention is produced by the fact that during the mixing operation the transport support is securely held and locked in the guide fork. More specifically, after the mixing operation has ended and the mixing vessel has returned to its starting position an exact repositioning of the first vessel part on the transport support is ensured.

THE DRAWINGS

The invention will be described in greater detail below with the and of the accompanying drawings, wherein.

Figure 1:
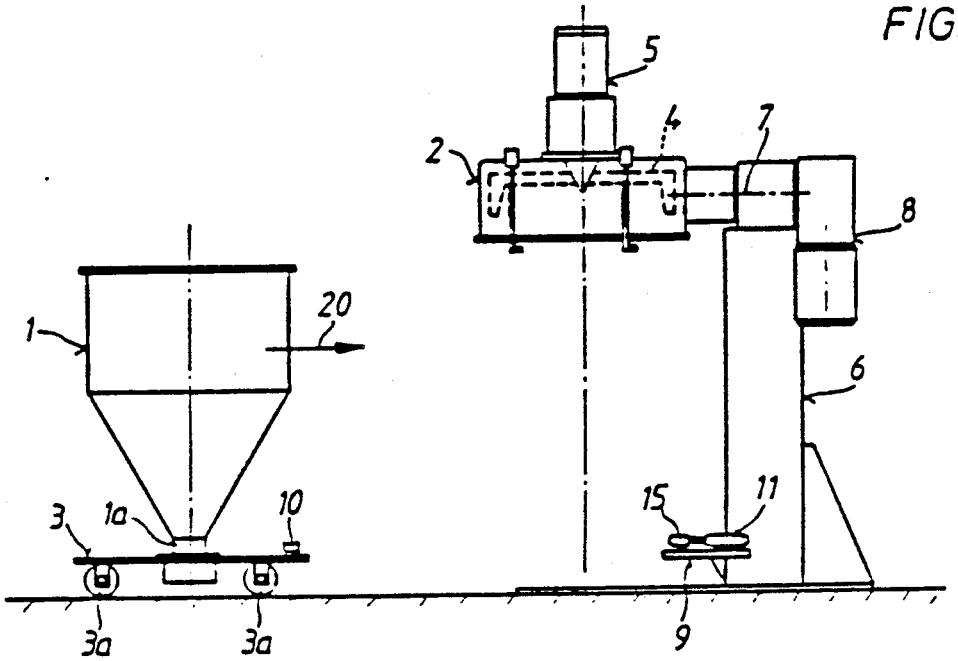
FIG. 1 shows a side view of the mixing device when the first mixing vessel part is moved into the starting position.
Figure 2:
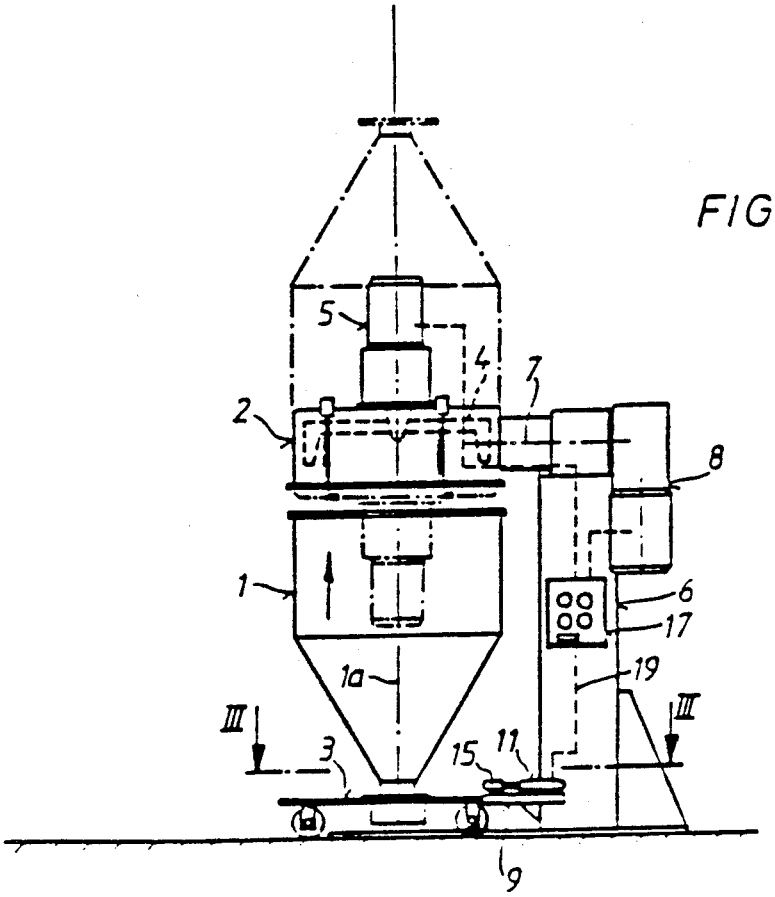
FIG. 2 shows a similar side view to that of FIG. 1, but with the vessel parts aligned with coincident vertical axes before being coupled together, and showing the transport support being drawn into the guide fork.

The mixing device according to the invention will be described generally first of all with the aid of FIGS. 1 and 2, in which the representation in FIG. 2 shows the overall construction or co-ordination of the mixing device.

The mixing device contains a mixing vessel which consists substantially of a movable first vessel part 1 and a stationary vessel part 2. The first vessel part 1 is provided with a base outlet 1*a* and it is borne by a transport support which in the illustrated embodiment is constructed in the form of a travelling pallet 3 with wheels 3*a* and on which the first vessel part 1 is releasably mounted in a manner which is commonly known per se and is therefore not illustrated in detail. In this way, the first vessel part 1 can be lifted off from this travelling pallet for connection to the second vessel part 2.

The second vessel part 2 is equipped with mixing tools 4 which are known per se and which can be driven in rotation by a motor drive unit.

The mixing device also contains a stationary mounting 6 on the upper end of which the second vessel part 2 is held stationary in such a way that with the aid of a pivot drive 8 it can be pivoted by 108° about a horizontal axis of rotation 7 between a starting position (approximately corresponding to FIG. 2), in which the second vessel part 2 forms the cover of the mixing vessel, and a mixing position (indicated by dash-dot lines in FIG. 2), in which the second vessel part 2 forms the base of the mixing vessel.

A guide fork 9 which is intended to receive the transport support (travelling pallet 3) in the starting position (and also in the mixing position) of the mixing vessel is also arranged fixed on the stationary mounting 6.

Figure 3:
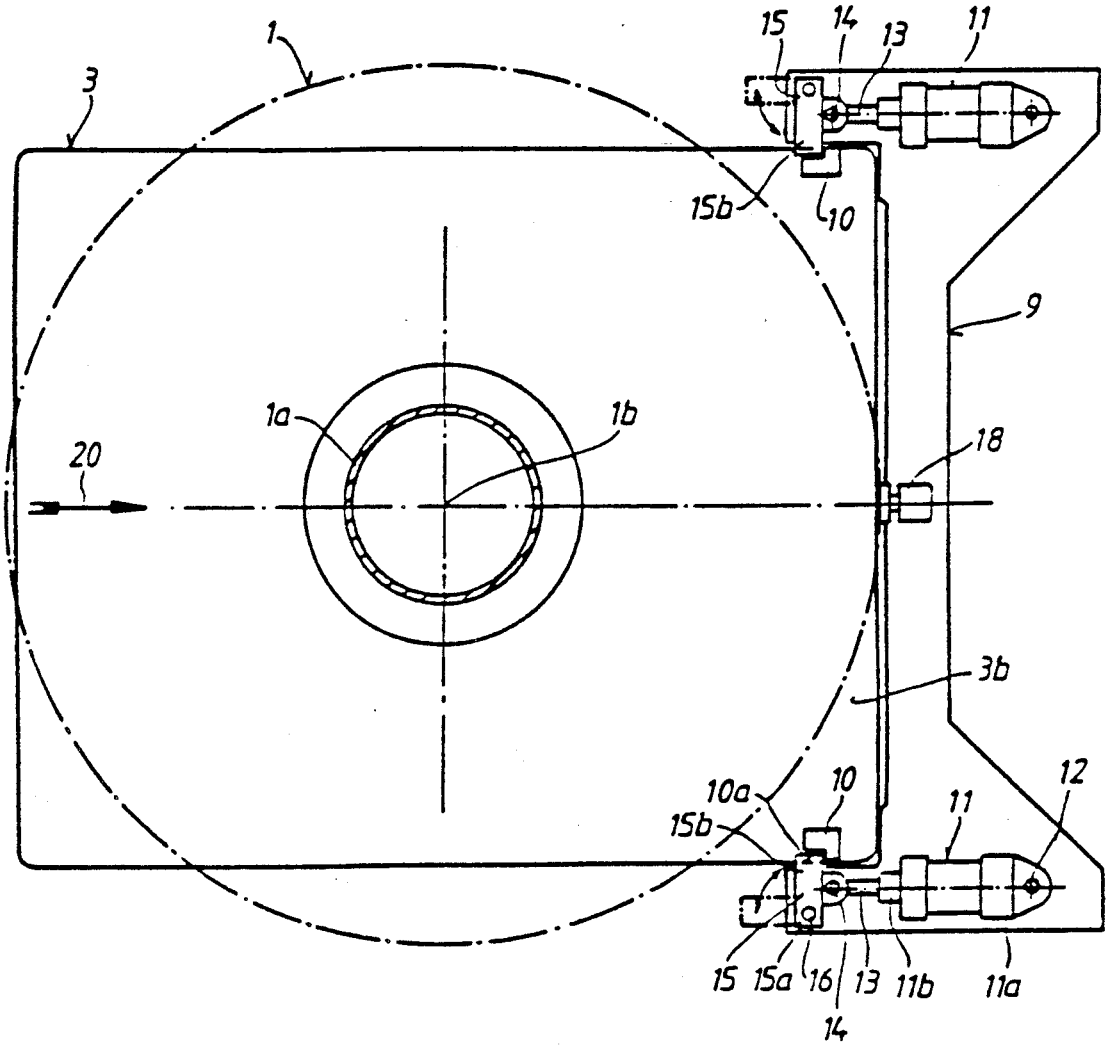
FIG. 3 shows a plan view of the transport support and the guide fork approximately corresponding to the line III—III in FIG. 2.

As is illustrated in particular in FIG. 3 the travelling pallet 3 and the guide fork 9, in the present examples two stop elements 10 are fixed, preferably welded, on the upper face of the travelling pallet 3 symmetrically on both sides of the vertical central axis 1*b* of the first vessel part 1 and on the end section 3*b* of the travelling pallet 3 facing the guide fork 9. By contrast, a clamping means or a draw-in device which can be brought into clamping engagement with these stop elements 10 is provided on the guide fork 9 in such a way that the travelling pallet 3 together with the first vessel part 1 can be drawn into the starting position of the mixing vessel and locked there.

The aforementioned draw-in device for the travelling pallet 3 contains cylinder-piston units 11 which are mounted on each side of the guide fork 9 and are operated by a pressure medium, preferably pneumatically. These two cylinder-piston units 11 are also arranged symmetrically on both sides of the vertical central axis 1*b* of the first vessel part 1 (and thus also of the mixing vessel axis determined thereby). Each cylinder-piston unit is associated with a stop element 10 of the travelling pallet 3 for clamping engagement.

In detail, each cylinder-piston unit 11 is mounted with one end 11*a* pivotable about a pivot pin 12 on the guide fork 9 and at its other end 11*b* is articulated (link pin 14) via the free end of its piston rod 13 with a pivot lever 15, one end 15*a* of which is rotatably mounted via a pivot pin 16 on the guide fork 9. The other end 15*b* is capable of being brought into clamping engagement with the appertaining stop element 10 of the travelling pallet 3.

As can be seen well in FIG. 3, each stop element 10 can be constructed in the form of a stop block welded on the travelling pallet 3, and each stop block can be of angular construction so that it has an engaging recess 10*a* for the appertaining pivot lever 15 or the end 15*b* thereof.

Whereas in this previously described embodiment two stop elements 10 are provided with these associated cylinder/piston units, in a particularly simple construction, and particularly in the case of smaller vessel types, one single stop element can be sufficient—with appropriately symmetrical mounting. It also goes without saying that the draw-in device provided on the guide fork can contain instead of the cylinder-piston units operated by a pressure medium, draw-in elements operated by other means, for example mechanical lever or spindle drives or electric pistons.

In a mixing device of the type explained above the mixing operation should also be capable in many cases of being controlled partly or fully automatically. For this purpose this mixing device contains an appropriately adapted control arrangement which is indicated in FIG. 2 at 17. With the aid of this control arrangement 17 the pivoting and mixing operation can be started and carried out in the desired manner.

In conjunction with such a control arrangement 17 it can also be particulary advantageous if the guide fork 9 bears and end switch or approach switch 18 which, as indicated by the broken line 19, is connected for control purposes to the control arrangement 17. The switch 18 can be actuated by the travelling pallet 3 which is fully moved into the guide fork 9, i.e. by the end section 3*b* of the travelling pallet 3 facing the guide fork 9. This construction particularly favours fully automatic operation of the mixing device. For example when the travelling pallet 3 which is moved together with the first vessel part 1 in the direction of the arrow 20 (FIGS. 1 and 3) into the guide fork 9 and locked there, then it switches the end switch 18 in such a way that as a result the entire mixing operation—beginning with the clamping of the two vessel parts 1 and 2 and the pivoting of the mixing vessel about the horizontal axis 7—can be started and carried out fully automatically.

What is claimed is:

1. Mixing apparatus comprising a first mixing vessel part; stationary support means for supporting said first mixing vessel part; a second mixing vessel part; movable transport means for supporting said second vessel part and being movable toward and away from said support means; guide means for guiding movement of said transport means toward said support means to a position in which said first and second vessel parts are aligned and may be coupled together; stop means mounted on said transport means; and combined driving and clamping means carried by said support means and engageable with said stop means for driving said transport means to said position and thereafter clamping said transport means in said position.

2. Mixing apparatus comprising a first mixing vessel part having a substantially vertical axis; stationary support means for supporting said first mixing vessel part; a second mixing vessel part having a substantially vertical axis; movable transport means for supporting said second vessel part and being movable to a position in which the vertical axes of said vessel parts are aligned and said mixing vessel parts may be coupled together; guide means comprising a pair of spaced apart arms on opposite sides of said vertical axis of said first vessel part and between which said second vessel part is accommodated when said transport means is in said position, said guide means being operable to guide said transport means during movement thereof to said position; a pair of stop elements mounted on said transport means and positioned symmetrically relative to said vertical axis of said second vessel part; and combined driving and clamping means carried by each of said arms in a position to engage the respective stop element as said transport means approaches said position, said combined driving and clamping means being operable to engage the respective stop elements and drive said transport means to said position and thereafter clamp said transport means in said position.

3. Mixing apparatus comprising a first mixing vessel part; stationary support means for supporting said first mixing vessel part; a second mixing vessel part; movable transport means for supporting said second vessel part and being movable toward and away from said support means; guide means for guiding movement of said transport means toward said support means to a position in which said first and second vessel parts are aligned and may be coupled together; stop means carried by said transport means; and combined driving and clamping means carried by said support means and engageable with said stop means for driving said transport means to said position and thereafter clamping said transport means in said position, said stop means comprising a pair of elements carried by said transport means symmetrically arranged at opposite sides of said transport means, said combined driving and clamping means comprising a pair of ram units symmetrically arranged on said support means in positions to engage the respective elements of said pair of elements, each of said ram units having a first end pivotally mounted to said guide means and a piston rod extending therefrom and terminating in a second end, said second end being pivotally mounted to a pivot lever, said pivot lever being pivotally mounted at one end to said guide means and including a free end capable of engaging the associated element.

4. Mixing apparatus according to claim 3 wherein said combined driving and clamping means comprises a rockable lever carried by said guide means and engageable with said stop means as said transport approaches said position, and power means for rocking said lever into and out of engagement with said stop means.

5. Mixing apparatus according to claim 4 wherein said power means comprises a ram.

6. Mixing apparatus comprising a first mixing vessel part having a substantially vertical axis; stationary support means for supporting said first mixing vessel part; a second mixing vessel part having a substantially vertical axis; movable transport means for supporting said second vessel part and being movable to a position in which the vertical axes of said vessel parts are aligned and said mixing vessel parts may be coupled together; guide means comprising a pair of spaced apart arms on opposite sides of said vertical axis of said first vessel part and between which said second vessel part is accommodated when said transport means is in said position; said guide means being operable to guide said transport means during movement thereof to said position; a pair of stop elements carried by said transport means and positioned symmetrically relative to said vertical axis of said second vessel part; and combined driving and clamping means carried by each of said arms in a position to engage the respective stop element as said transport means approaches said position, said combined driving and clamping means being operable to engage the respective stop elements and drive said transport means to said position and thereafter clamp said transport means in said position, said combined driving and clamping means comprising a rockable lever carried by said guide means and engageable with the respective stop elements as said transport approaches said position, and power means for rocking said lever into and out of engagement with said respective stop elements.

7. Mixing apparatus according to claim 6 wherein said power means comprises a ram.

8. Mixing apparatus according to claim 6 including rotary means carried by said support means for rotating said first and second vessel parts when coupled together about a substantially horizontal axis.

9. Mixing apparatus according to claim 8 including means responsive to movement of said transport means to said position to actuate said rotary means.

* * * * *